US009733007B2

(12) United States Patent
Keast et al.

(10) Patent No.: US 9,733,007 B2
(45) Date of Patent: Aug. 15, 2017

(54) LIQUID VESSEL COOLING SYSTEM

(71) Applicants: Kenneth Keast, San Jose, CA (US); John Splawn, Saratoga, CA (US)

(72) Inventors: Kenneth Keast, San Jose, CA (US); John Splawn, Saratoga, CA (US)

(73) Assignee: Beergo, Inc., San Jose, CA (US)

( * ) Notice: Subject to any disclaimer, the term of this patent is extended or adjusted under 35 U.S.C. 154(b) by 100 days.

(21) Appl. No.: 14/217,128

(22) Filed: Mar. 17, 2014

(65) Prior Publication Data

US 2014/0260412 A1 Sep. 18, 2014

Related U.S. Application Data

(60) Provisional application No. 61/790,176, filed on Mar. 15, 2013.

(51) Int. Cl.

| | |
|---|---|
| ***F25D 11/00*** | (2006.01) |
| ***F25D 31/00*** | (2006.01) |
| ***B67D 1/08*** | (2006.01) |

(52) U.S. Cl.

CPC ..... *F25D 11/003* (2013.01); *B67D 1/0857* (2013.01); *F25D 31/002* (2013.01)

(58) Field of Classification Search

CPC ..... F25D 31/006; F25D 2331/802; F25D 31/002; B65D 81/3886; B67D 1/0862

See application file for complete search history.

(56) References Cited

U.S. PATENT DOCUMENTS

| | | | | |
|---|---|---|---|---|
| 2,214,344 | A * | 9/1940 | Paul | F25D 31/003 165/169 |
| 4,164,853 | A * | 8/1979 | McDonough | F25D 3/06 222/108 |
| 4,350,267 | A * | 9/1982 | Nelson | B67D 1/06 222/131 |
| 4,633,678 | A * | 1/1987 | Lea | B67D 1/0857 220/592.19 |

* cited by examiner

*Primary Examiner* — Cassey D Bauer
(74) *Attorney, Agent, or Firm* — Temmerman Law Office; Mathew J. Temmerman

(57) ABSTRACT

An improved liquid vessel cooling system for cooling, transporting and dispensing liquid comprises a base assembly having a base housing enclosing a refrigeration unit and having a top surface and a bottom surface, the top surface attached to a thermally conductive support base snugly encircled by a plurality of evaporator coils. In alternate embodiments the evaporator coils may be incorporated within the support base structure or the support base structure may be constructed with cavities and passages such that the support base structure itself functions as the plurality of evaporator coils. A container containing the liquid is attached to the support base and comprises a top portion, a bottom portion and a spear that extends inside the container from the top portion to proximate the bottom portion. An insulation sleeve is removably positioned over the container through a first opening at a middle portion thereof. The insulation sleeve includes a second opening at a bottom portion to fill with an insulating material.

20 Claims, 8 Drawing Sheets

LIQUID VESSEL COOLING SYSTEM

RELATED APPLICATIONS

This application claims priority from the U.S. provisional application with Ser. No. 61/790,176 filed on Mar. 15, 2013. The disclosure of the provisional application is incorporated herein as if set out in full.

BACKGROUND OF THE DISCLOSURE

Technical Field of the Disclosure

The present embodiment relates in general to cooling processes and apparatuses. More specifically, the present disclosure relates to an improved liquid vessel cooling system having an insulation sleeve for cooling, transporting and dispensing beverages from kegs.

Description of the Related Art

While entertaining at home or traveling to and from various locations, such as games, picnics, fishing or the like, individuals or groups of people may find it desirable to maintain beverages in cold condition. In the past, the attempted solution to this problem has been to put a keg of liquid in a tub/container filled with ice. This solution has its drawbacks and can be ineffective because the ice often melts quickly, causing unsanitary and unsightly conditions, so a great quantity of ice must be replaced to keep the beverage cold which can be time-consuming and costly.

A conventional means for solving this problem is the use of fresh barrels or refrigerated beverage machines or a keg refrigeration unit such as a kegerator to store a large number of refrigerated beers or other beverages. However, the size of the kegerator is large and the device requires constant external electrical input. The kegerator is also heavy, expensive and not easily portable. Regular refrigerators are also impractical and inefficient because they take a long time to properly cool a beverage container and suffer from all the other drawbacks suffered by the kegerator. Additionally, keg refrigeration units, like the majority of cooling/refrigeration systems, treat their contents like thermal black boxes. Regardless of whether the refrigeration unit contains a beer keg, gallon of milk, or box of apples, the contents are enveloped in cold air, and the assumption is made that given enough time the items inside will approach the ambient temperature in the unit. There are efficiency losses inherent in this system, made worse due to the old air that quickly escapes each time the door is opened.

Cold refreshments are often desired in places where power outlets are not convenient or not available. It is particularly desirable to provide a combined refrigerator and portable cooler for use in a location where power is not available or cannot practically be made available. Many attempts have been made to combine the refrigeration unit and the portable cooler. One of the existing portable coolers employs a keg containing a suitable beverage such as a soft drink/juice, lemonade, energy drinks, beer, etc. to be dispensed by a rigid tap and hose. In addition, the portable coolers channel cold air to keep beverages consistently chilled and fresh upon dispensing. However, these coolers do not provide efficient insulation and thus the beer/beverages cannot remain cool for a long time, particularly on a hot day.

Attempts have been made to compensate for this instability by including an insulation material/layer or insulators to the beverage kegs. However, the thermal insulation provided by the insulators has not been entirely satisfactory. Typically, available insulators have either been constructed as a jacket slipover or as an insulating wrap. Both, however, leave portions of the keg exposed and thus do not provide a complete enclosure in order to achieve optimal insulation to the keg. In addition, such insulators are not provided with any means to transport the keg by hand.

Therefore, there is a need for an improved, small, lightweight and portable liquid vessel cooling system that would provide effective and efficient cooling, transporting and dispensing of beverages, particularly from kegs. Such an improved liquid vessel cooling system includes an insulation sleeve that would be reusable, collapsible, and easily storable. This insulation sleeve would provide an efficient insulation to allow beverages to remain cool for a long time. Such an improved liquid vessel cooling system would completely enclose a keg container in order to achieve more thermal insulation to the keg container. Such a needed device would provide a means to transport the keg easily by hand. Such a system would be able to form and melt ice crystals at a bottom portion of the keg container allowing the ice to float to the warmer liquid at a top portion and thereby attain a cool, even temperature throughout the beverage. This system would include a refrigeration unit for cooling and a dispensing means to effectively dispense the cooled beverage from the keg, while the keg is in upright position. Further, this system would induce convection currents within the keg container so as to enable more uniform cooling of the beverage contained therein. Finally, this system would be clean, hygienic and simple to use.

SUMMARY OF THE DISCLOSURE

To minimize the limitations found in the prior art, and to minimize other limitations that will be apparent upon the reading of the specification, the preferred embodiment of the present invention provides a liquid vessel cooling system for cooling, transporting and dispensing beverages. The liquid vessel cooling system comprises a base assembly having a base housing with a top surface and a bottom surface. The top surface of the base housing is attached to a support base and a refrigeration unit is enclosed within the base housing. The thermally conductive support base is snugly encircled by a plurality of evaporator coils. In alternate embodiments the support base may be incorporate the plurality of evaporator coils within its structure, or may comprise a plurality of cavities and passages such that the support base itself functions as the plurality of evaporator coils. A container containing liquid is attached to the support base. The container includes a top portion, a bottom portion and a spear that extends inside the container from the top portion to proximate the bottom portion. The liquid vessel cooling system further comprises an insulation sleeve that is removably positioned over the container through a first opening at a middle portion thereof. The base assembly and the insulating sleeve are configured to effectively and efficiently cool the liquid contained within the container.

The plurality of evaporator coils encircled in the support base is configured to induce convection currents within the container so as to enable more uniform cooling of the contained liquid. Preferably, the plurality of evaporator coils is toroidal or donut in shape. The insulation sleeve includes a second opening at the bottom portion thereof to fill with an insulating material. The spear allows the user to extract the liquid from the container while the container is in an upright position. The spear is connected to a dispensing unit having a dispensing tap that is attached to a liquid line and a carbon dioxide ($CO_2$) line. The base assembly further comprises at least one wheel that is adaptable to provide movement of the liquid vessel cooling system while transporting with or without the container installed.

A first objective of the present invention is to provide a liquid vessel cooling system that is small, portable and lightweight.

A second objective of the present invention is to provide a liquid vessel cooling system that exploits the characteristics of a keg of liquid.

A third objective of the present invention is to provide a liquid vessel cooling system that is clean, hygienic and simple to use.

A fourth objective of the present invention is to provide a liquid vessel cooling system that is used to cool beverages, which may be non-alcoholic beverages, such as orange juice, cola and the like, or alcoholic beverages such as beer or lager.

A fifth objective of the present invention is to provide a liquid vessel cooling system that includes an insulated sleeve that can be easily slipped over a container to keep it and liquid contained in the container cold for long periods of time.

A sixth objective of the present invention is to provide a liquid vessel cooling system that includes an insulated sleeve that is light, flexible, collapsible and easily transportable.

A seventh objective of the present invention is to provide a liquid vessel cooling system that includes an insulation sleeve that is flexible and can be stored easily for repeated use.

An eighth objective of the present invention is to provide a liquid vessel cooling system that includes an insulation sleeve having an opening to access a dispensing unit attached to a spear of the container.

A ninth objective of the present invention is to provide a liquid vessel cooling system that includes a plurality of evaporator coils that induce convection currents within the keg container so as to enable more uniform cooling of the beverage contained therein.

Another objective of the present invention is to provide a liquid vessel cooling system that includes a plurality of evaporator coils that are in thermal contact with a liquid vessel and in turn with the contained liquid, thereby enabling cooling through direct thermal conduction.

Another objective of the present invention is to provide a liquid vessel cooling system that includes at least one wheel that is adaptable to provide movement of the liquid vessel cooling system while transporting with or without the container installed.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
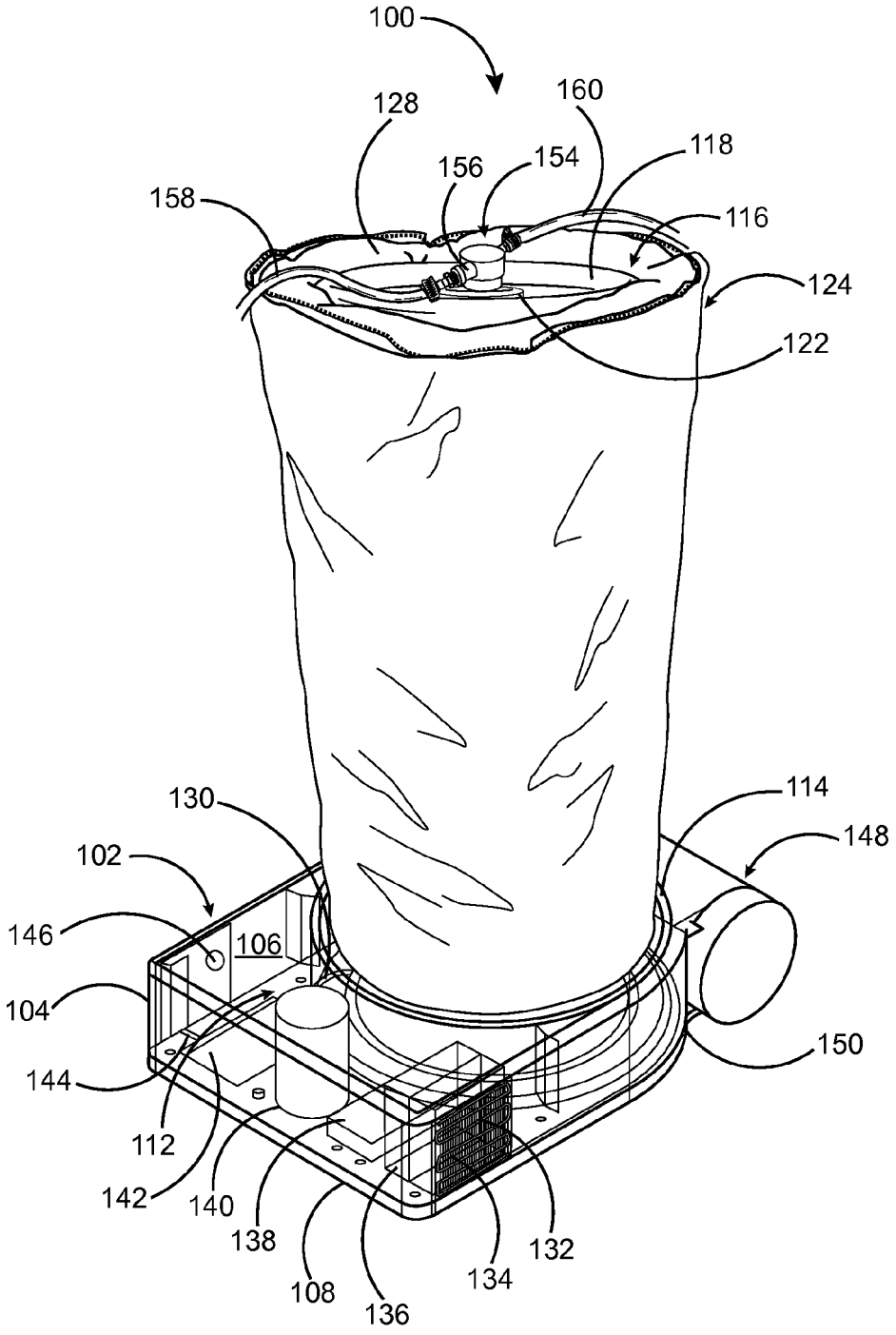
FIG. 1 illustrates a partial schematic view of a liquid vessel cooling system in accordance with the preferred embodiment of the present invention.
Figure 2:
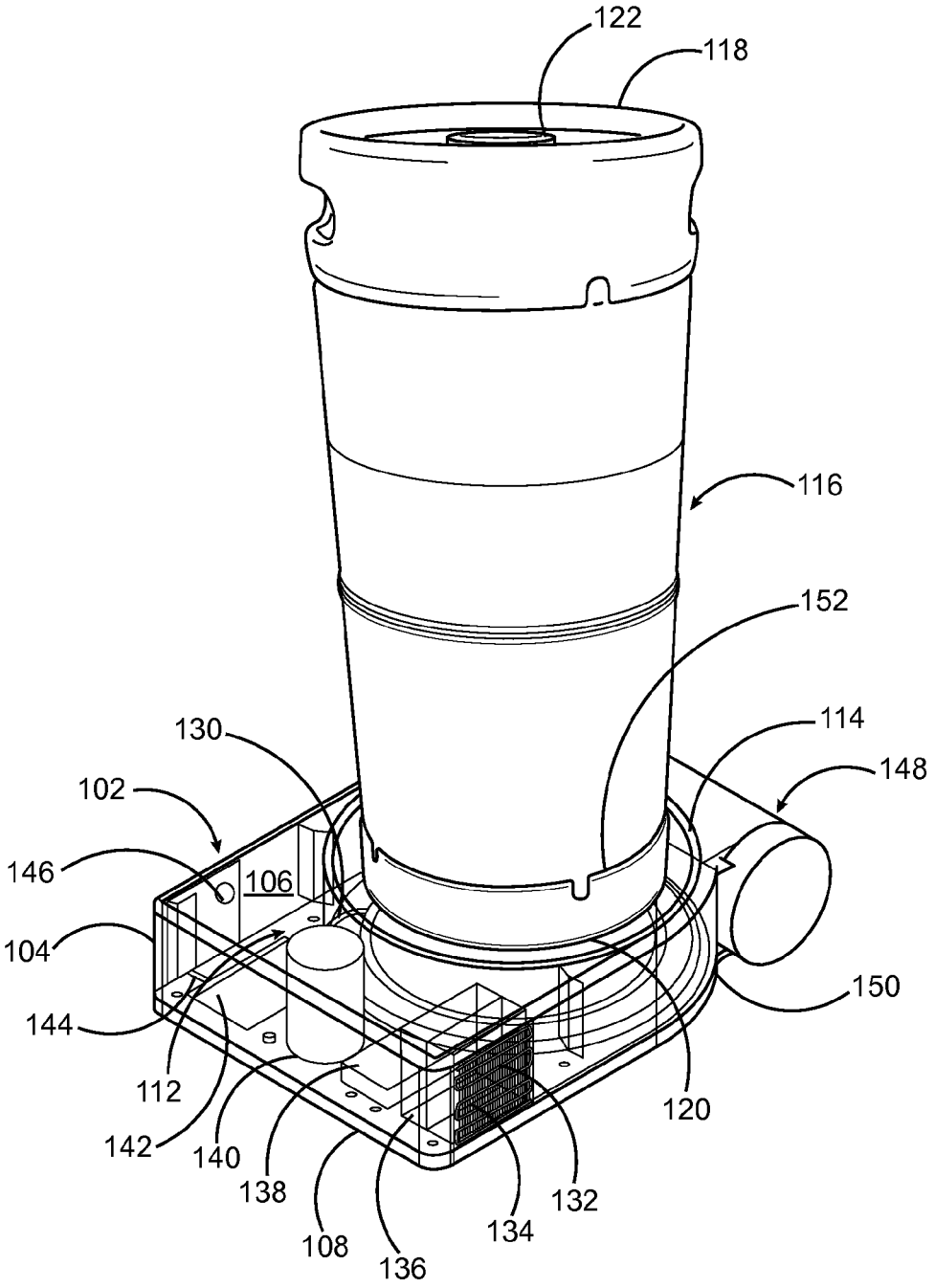
FIG. 2 illustrates a partial schematic view of a liquid vessel cooling system with an insulation sleeve and a dispensing unit shown in FIG. 1 being removed for clarity.
Figure 8A:
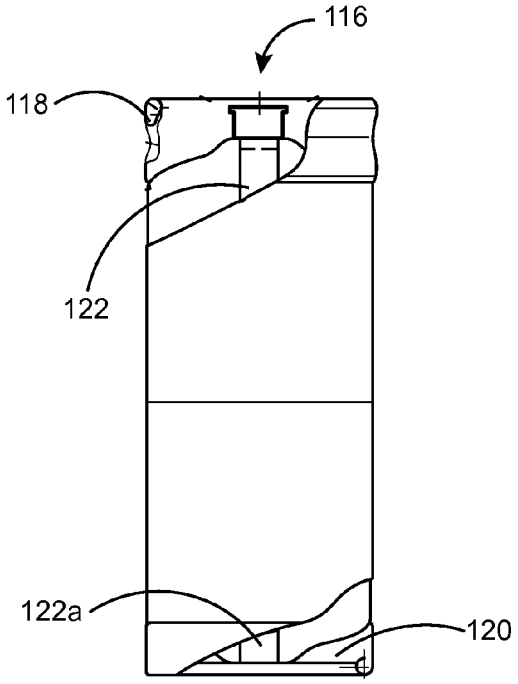
FIG. 8A illustrates a partial cutaway view of the preferred embodiment of the invention.
Figure 8B:
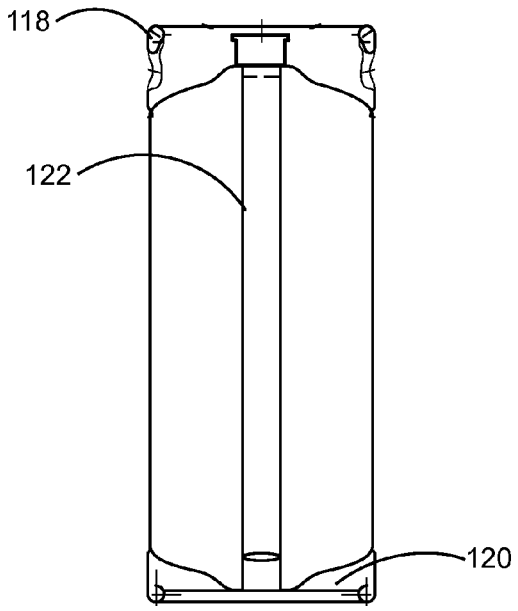
FIG. 8B illustrates a cutaway view of the preferred embodiment of the invention.
Figure 9A:
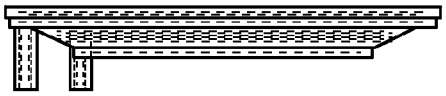
FIG. 9A illustrates a first view of an alternative embodiment of the invention wherein the support base comprises cavities and passages such that the support base functions as the plurality of evaporator coils.
Figure 9B:
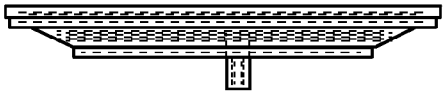
FIG. 9B illustrates a second view of the alternative embodiment of the invention wherein the support base comprises cavities and passages.
Figure 9C:
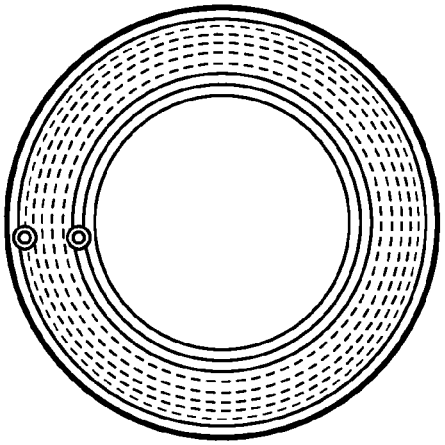
FIG. 9C illustrates a third view of the alternative embodiment of the invention wherein the support base comprises cavities and passages.
Figure 9D:
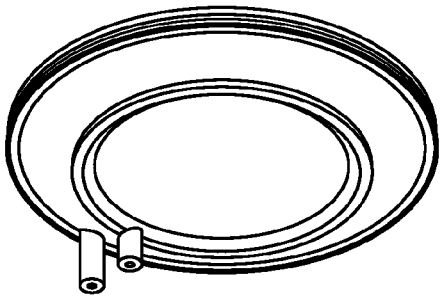
FIG. 9D illustrates a fourth view of the alternative embodiment of the invention wherein the support base comprises cavities and passages.

Turning first to FIGS. 1 and 2, schematic views of a liquid vessel cooling system in accordance with the preferred embodiment of the present invention are illustrated. The liquid vessel cooling system 100 comprises a base assembly 102 having a base housing 104 with a top surface 106 and a bottom surface 108. The top surface 106 of the base housing 104 is attached to a support base 110 (See FIG. 3) and a refrigeration unit 112 is enclosed within the base housing 104. The thermally conductive support base 110 (See FIG. 3) is snugly encircled by a plurality of evaporator coils 114 (See FIG. 3). In alternate embodiments the support base may be incorporated in the plurality of evaporator coils within its structure, or may comprise a plurality of cavities and passages such that the support base itself functions as the plurality of evaporator coils, such as is shown in FIGS. 9A, 9B, 9C, and 9D. The evaporator coils may contact a container 116 containing liquid is attached to the support base 110 (See FIG. 3). The container 116 as discussed herein, for purposes of explanation and technical description, comprises a pre-chilled keg containing a suitable beverage such as a soft drink, lemonade, beer, malt liquor, etc. to be dispensed. The container 116 includes a top portion 118, a bottom portion 120 (See FIG. 2) and a spear 122 that extends inside the container 116 from the top portion 118 to proximate the bottom portion 120 (See FIG. 2). See also FIGS. 8A and 8B wherein cross-sectional depictions of the system depict the spear 122 extending the inside of the container 116 to a spear bottom portion 122*a*. The liquid vessel cooling system 100 further comprises an insulation sleeve 124 that is removably positioned over the container 116 through a first opening 126 (See FIG. 3) and a second opening 162 (See FIG. 6) at a middle portion 128 thereof. The base assembly 102 and the insulating sleeve 124 are configured to effectively and efficiently cool the liquid contained within the container 116.

The refrigeration unit 112 employs a standard evaporation-condensation cycle as is known in the art. The refrigeration unit 112 may comprise, for example, at least some of the following components: refrigerant lines/condensation trough(s) 130, condenser 132, dust filter 134, pulling fan 136, drive board 138, compressor 140, evaporation tray 142, overflow drain tray 144, capillary tubing or metering device (not labeled), and outlet 146, as well as other refrigeration components as known in the art. It should be understood that the refrigeration lines/condensation trough(s) 130 and the compressor 140 are shown for exemplary purposes only, and that any suitable refrigeration unit may be utilized. In the preferred embodiment, the refrigeration unit 112 is a compact and/or lightweight unit suitably sized to fit within or about the base housing 104, including but not limited to high efficiency refrigeration units. Optionally, one or more other components of the refrigeration unit 112 may be mounted on the exterior of the liquid vessel cooling system 100.

In a preferred embodiment, the refrigeration unit 112 is powered by standard 110V or 220V AC power. In alternate embodiments, the refrigeration unit 112 may be powered by other voltages of AC or DC current, by rechargeable batteries, or by a fuel such as, but not limited to, propane. In addition, the different embodiments of the liquid vessel cooling system 100 may support cooling of any sized container. The liquid vessel cooling system 100 may be used to cool and refrigerate any known container size or shape.

The base assembly 102 further comprises at least one wheel 148 that is adaptable to provide movement of the liquid vessel cooling system 100 while transporting with or without the container 116 installed. Typically, the at least one wheel 148 is pivotally mounted to a lower end 150 of the base housing 104, allowing the liquid vessel cooling system 100 to be transported to any desired location. The at least one wheel 148 may enable dolly type movement, or may enable flat sliding type movement.

The spear 122 is connected with a dispensing unit 154 having a dispensing tap 156 that is attached to a liquid line 158 and a carbon dioxide ($C_{O2}$) line 160. When a glass of liquid, for example, beverage is desired, the dispensing tap 156 opens and beverage is dispensed through the liquid line 158 into the glass. The liquid vessel cooling system 100 may further be attached to a carbonator that is fitted to the incoming carbon dioxide line 160. The carbonator mixes the liquid with carbon dioxide to make carbonated liquid.

The liquid vessel cooling system 100 may additionally comprise of a strap system that allows the container 116 to be temporarily attached to the base housing 104 while transporting. Thus, the liquid vessel cooling system 100 provides an easier dolly type movement. The strap system may be easily detached, collapsed and stored when not in use. The liquid vessel cooling system 100 may alternatively comprise a locking mechanism that is configured to engage an outer rim 152 (See FIG. 2) of the bottom portion 120 of the container 116 to the support base 110 to temporarily lock the container 116 to the support base 110 while transporting and while not in transport to enhance contact between 120 and 110. Thus, the liquid vessel cooling system 100 provides an easy-to-use dolly type movement. The strap system may be easily detached, collapsed and stored when not in use and in an alternative embodiment (not shown) the outer rim 152 connection is replaced or enhanced by an inner rim connection on the bottom portion of the container 116.

The liquid vessel cooling system 100 further includes a color-coded system having a plurality of color-coded wires and inlets that facilitate a user to setup the liquid vessel cooling system 100. Some of the components of the present invention, such as, but not limited to, carbon dioxide ($CO_2$) cylinder and serving hardware, may include color coding or symbols to make an easier setup process. The liquid vessel cooling system 100 may additionally contain a separate piece to extend a handle of a coupler to make it easier to tap the container 116. Tapping provisions may also include integrated serving provisions such as one or more traditional lever operated taps or taps activated by alternate means such as electronic sensors or buttons.

In one embodiment, the liquid vessel cooling system 100 may further comprise a carbon dioxide ($CO_2$) system to facilitate charging the container 116 and pushing the liquid out of the container 116. Moreover, the support base 110 or the insulation sleeve 124 may comprise a holder for the carbon dioxide ($CO_2$) system as is known in the art to charge the container 116 and push liquid, commonly beer, out of the container 116. The liquid vessel cooling system 100 with the carbon dioxide ($CO_2$) system may be adapted for carbonated drink dispensing. The carbon dioxide ($CO_2$) system may comprise one or more of a pressurized $CO_2$ cylinder and dispensing port, which may be connected through a series of tubes. Flow through the carbon dioxide ($CO_2$) system may be delivered via one or more in-line mechanical pumps. Optionally, the carbon dioxide ($CO_2$) system may include a trigger-operated delivery gun, which may be adapted to dispense the beverage. In certain aspects, the $CO_2$ cylinder of the carbon dioxide ($CO_2$) system may be located on an exterior of the base housing 104 in a compartment adapted to removably receive and secure the cylinder. According to this embodiment, an opening in the base housing 104 may provide communication between the CO2 cylinder and an interior of the compartment.

In one embodiment, the liquid vessel cooling system 100 may also cool through the direct conduction of heat energy, first from liquid to liquid, then from liquid to the base and/or sidewalls of the container 116, and in turn an evaporator. The liquid vessel cooling system 100 may be capable of cooling solely through this direction conduction mode in most operating conditions as a failsafe with reduced capacity. The liquid vessel cooling system 100 may additionally comprise of features both passive and active in nature to enable cooling of the sidewalls and the bottom portion 120 of the container 116. The liquid vessel cooling system 100 may alternatively use heat pipes or a secondary evaporator for thermal conduction.

In one embodiment, different configurations of the container 116 may be possible. The shape of the plurality of evaporator coils 114 can be varied based on the construction of the container 116. Specifically, a flat bottomed container with an offset spear would benefit from a flat shaped cooling surface several inches across placed on a bottom and opposite the offset spear, thus relying on the same mechanism to set up tumbling convection inside a drum.

In an alternate configuration, the liquid vessel cooling system 100 comprises a stacking rack consisting of a cylindrical frame, slightly larger than the container 116 in diameter and approximately 3"-9" thick designed to stack two or more containers one above the other. This configuration may be designed to cool either, both, or neither container and may have provisions for tapping containers stacked in this configuration ranging from integrated fittings to hollowed spaces to provide access to an external tapping hardware. When combined with the insulation sleeve 124 surrounding the exposed surfaces of the containers, a freestanding temporary vertical refrigeration rack can be created. The cylindrical-stacking racks include provisions for tapping containers and may have handles, levers, integral designs elements, or separate implements designed to reduce the effort required to perform the tapping. An evaporator coil that contacts the outside collar of spear 122 with the purpose of cooling the beverage by making contact through this surface located at the top of container 116 may be in close proximity and just underneath dispensing unit 154 of container 116 and may also be included in these integral designs. An evaporator coil making contact with any surface of container 116 with the purpose of cooling beverage may be included in these integral designs.

Figure 3:
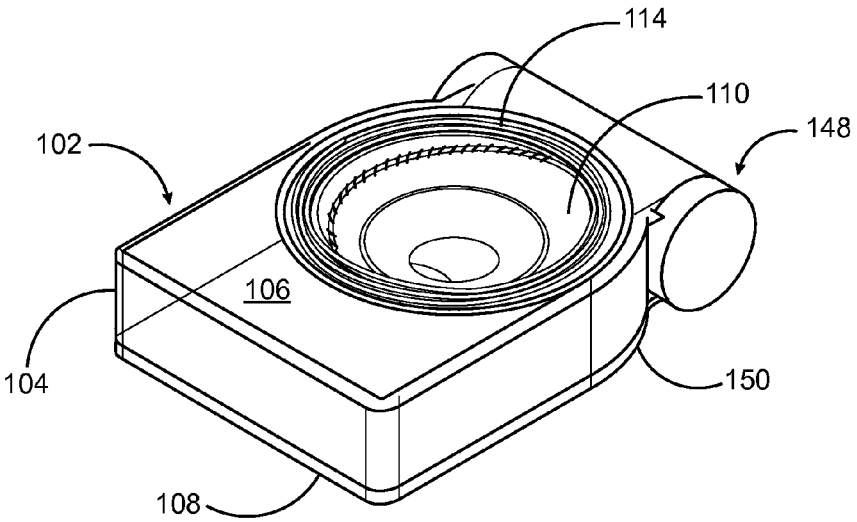
FIG. 3 illustrates a partially exploded view of the liquid vessel cooling system in accordance with the preferred embodiment of the present invention.
Figure 3:
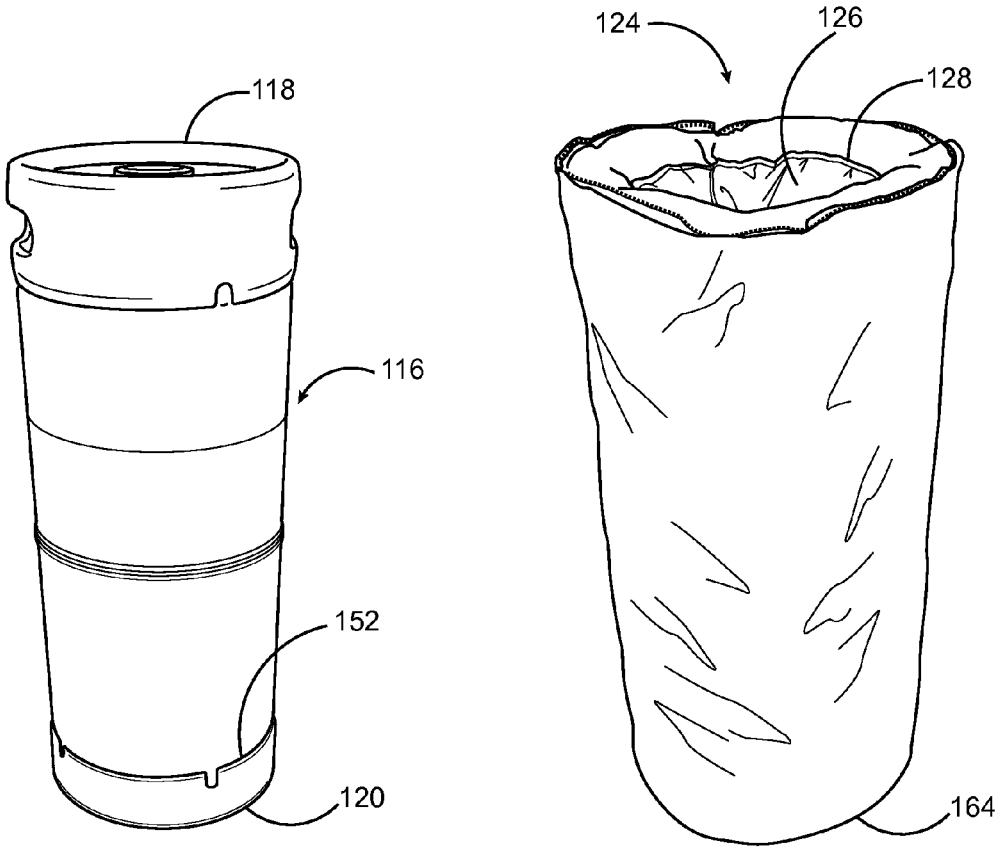

FIG. 3 illustrates a partially exploded view of the liquid vessel cooling system in accordance with the preferred embodiment of the present invention. The plurality of evaporator coils 114 encircled in the support base 110 is configured to induce convection currents within the container 116 so as to enable more uniform cooling of the contained liquid. Preferably, the plurality of evaporator coils 114 is toroidal or donut in shape. The plurality of evaporator coils 114 is further configured to control the quantity of thermal conductivity energy flowing into or out of the container and the profile of the thermal gradient across the container 116 allowing the walls of the container 116 to be effectively cooled to form a thermal differential between the spear 122 and the container 116.

A coolant circulates and evaporates within the plurality of evaporator coils 114 and cools the container 116 by direct thermal conduction, as opposed to indirect convection using cold air as an intermediary as is the case in a standard refrigerator or kegerator. Said again, minimal to no air is present in the system. In some embodiments, the support base 110 further comprises advanced polymer materials or other thermally conductive materials disposed between the plurality of evaporator coils 114 and the container 116 to increase the rate and efficiency of heat transfer from the container 116 to the plurality of evaporator coils 114. The plurality of evaporator coils 114, preferably, contacts the bottom portion 120 of the container 116 so that even if the container 116 is part empty, a portion of the container 116 that contains liquid will remain cooled.

The toroidal design of the plurality of evaporator coils 114, and its interface with the container 116, enables efficient cooling of the liquid contained within the container 116. In one embodiment, the cooling of the liquid can be increased through various direct methods such as moving cooled liquid to ensure even cooling and to avoid freezing, for example with magnetic stirrers and the design of containers in combination with the design of the liquid vessel cooling system 100.

The base housing 104 may be of any shape that can accommodate the refrigeration unit 112, and support the container 116. Although the base housing 104 shown in FIGS. 1, 2 and 3 has a square shape, it is noted that the base housing 104 can be available in different shapes and sizes including triangular and circular shapes. In the preferred embodiment, the base assembly 102 is approximately 4 inches in height and is approximately 9 inches by 13 inches by 3.5 inches and is configured to cool ⅙ barrel size kegs. In alternate embodiments, the base housing 104 may be of any appropriate height. The base housing 104 preferably comprises a lightweight, strong material such as but not limited to plastic, metal, or composite.

The insulation sleeve 124 is positioned over the container 116 through an open bottom portion 164 thereof. The insulation sleeve 124 is attached with the support base 110 in such a way that little heat is allowed to enter the volume enclosed by the support base 110 and the insulation sleeve 124. The insulating sleeve 124 is configured to enable effective, efficient, and cheap cooling of the container 116. The liquid vessel cooling system 100 is capable of exploiting the characteristics of the keg of liquid.

Figure 4:
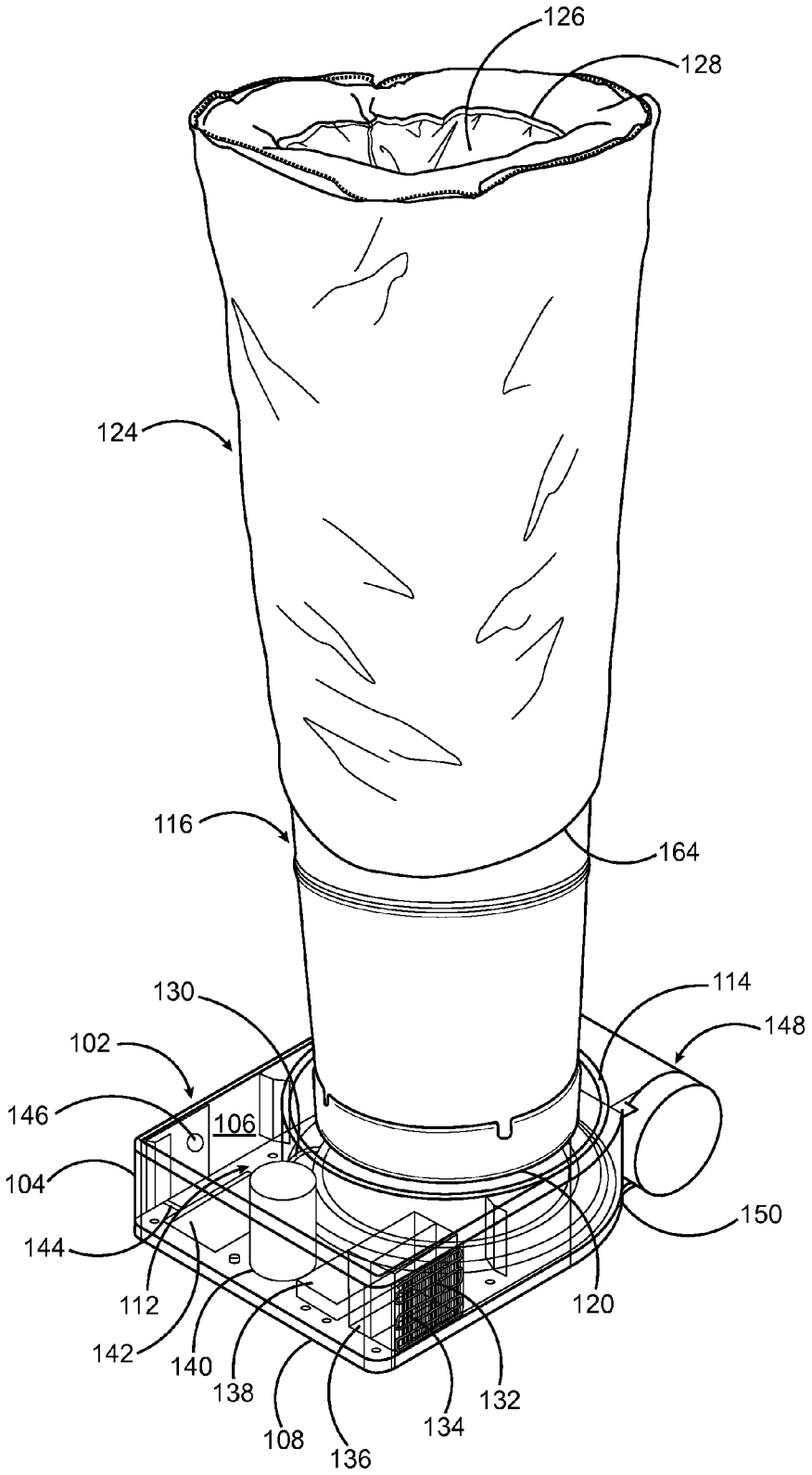
FIG. 4 illustrates a perspective view of the liquid vessel cooling system, illustrating an insulation sleeve positioning over a container in accordance with the preferred embodiment of the present invention.

FIG. 4 illustrates a perspective view of the liquid vessel cooling system 100, illustrating the insulation sleeve 124 positioning over the container 116 in accordance with the preferred embodiment of the present invention. In use, the container 116, typically the keg of liquid, is placed in the support base 110 and the insulation sleeve 124 is then placed over the container 116 forming a well insulated chamber or volume containing the container 116. The insulation sleeve 124 is positioned over the container 116 through the bottom portion 164 of the insulation sleeve 124. Specifically, the type, quantity, quality and arrangement of insulation within the insulation sleeve 124 are selected to facilitate efficient operation and even cooling.

Figure 5:
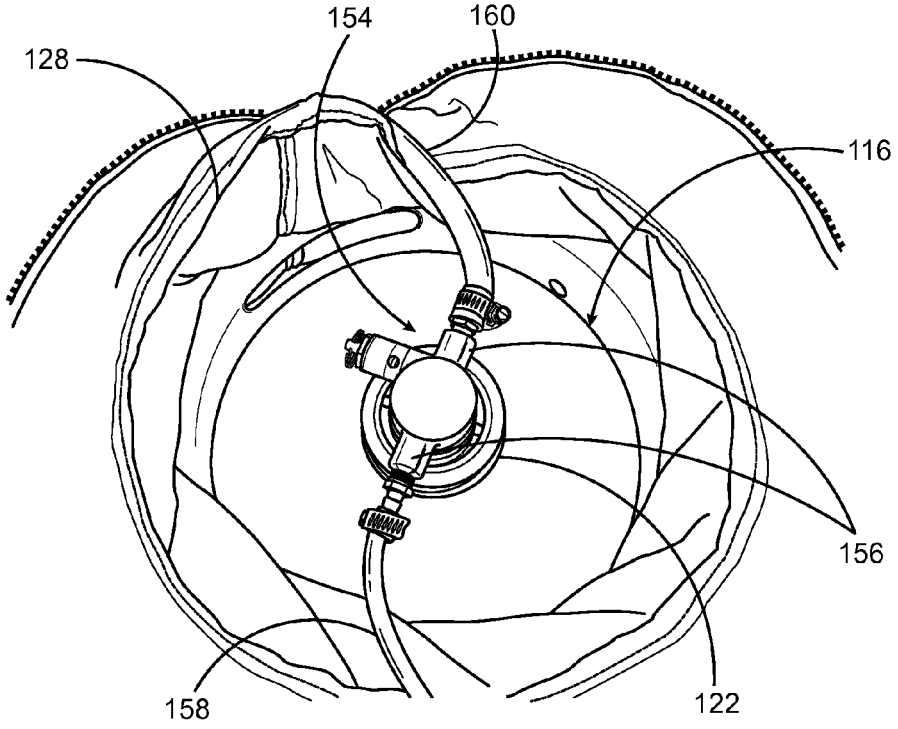
FIG. 5 illustrates a top perspective view of the liquid vessel cooling system, illustrating a dispensing unit attached to a spear of the container in accordance with the preferred embodiment of the present invention.

FIG. 5 illustrates a top perspective view of the liquid vessel cooling system, illustrating the dispensing unit attached to the spear of the container in accordance with the preferred embodiment of the present invention. The spear 122 allows the user to extract the liquid from the container 116 while the container 116 is in an upright position. The spear 122 is connected to the dispensing unit 154 having the dispensing tap 156 that is attached to the liquid line 158 and the carbon dioxide ($C_{O2}$) line 160. The dispensing tap 156 can be a service tap, either carbon dioxide ($C_{O2}$) or a hand pump as known in the art. In use, the liquid is dispensed from the dispensing tap 156. The liquid is dispensed by means of a carbon dioxide ($C_{O2}$)-pressurized system or alternatively by a pumping mechanism. Liquid is passed from the container 116 along the liquid line 158.

The spear 122 conducts thermal energy from the relatively warm liquid at the top portion 118 of the container 116, as well as any leaking thermal energy from outside the container 116 via a tank feed, to the cooled liquid at the bottom portion 120 of the container 116 when the container 116 is cooled in the liquid vessel cooling system 100. The donut or toroidal shape of the plurality of evaporator coils 114 controls the thermal conductivity of the container 116 and allows the walls of the container 116 to be effectively and efficiently cooled, thus setting up a thermal differential between the spear 122 and the walls of the container 116.

The thermal differential initiates natural convection currents within the container 116, which ensures that temperature differential throughout the cooled liquid within the container 116 is low.

Additionally or alternatively, the liquid vessel cooling system 100 provides a fail-safe feature by periodically allowing ice crystals formed at the bottom portion 120 of the container 116 to melt. The melted ice crystals float on the top portion 118 of the container 116 and are completely melted by the warm liquid in the top portion 118 of the container 116. This feature provides a method of cooling liquid comprising primarily water as the ice formation and melting will help to attain an even temperature throughout the liquid.

Figure 6:
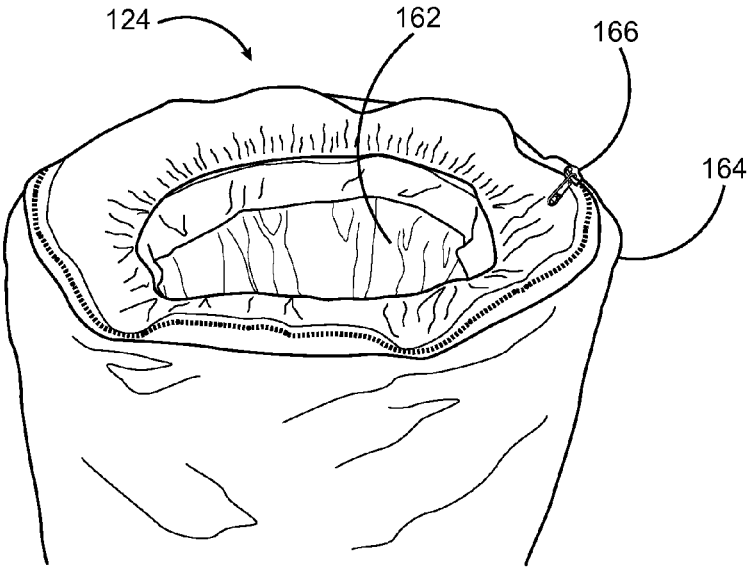
FIG. 6 illustrates a perspective view of a bottom portion of the insulation sleeve in accordance with the preferred embodiment of the present invention.

FIG. 6 illustrates a perspective view of the bottom portion of the insulation sleeve in accordance with the preferred embodiment of the present invention. The insulation sleeve 124 includes a second opening 162 at the bottom portion 164 thereof to fill with an insulating material. The insulation sleeve 124 is easily collapsed by removing the insulating material and stored when not in use. The insulation material is selected from a group consisting of: foam, neoprene, plastic, quilted material and any other vacuum supporting materials. The second opening 162 can be closed and opened utilizing at least one fastening means 166. Preferably, the at least one fastening means 166 is zipper. The at least one fastening means 166 allows the user to replace the insulating material, remove it for easier smaller storage, or remove it for simple washing.

Figure 7A:
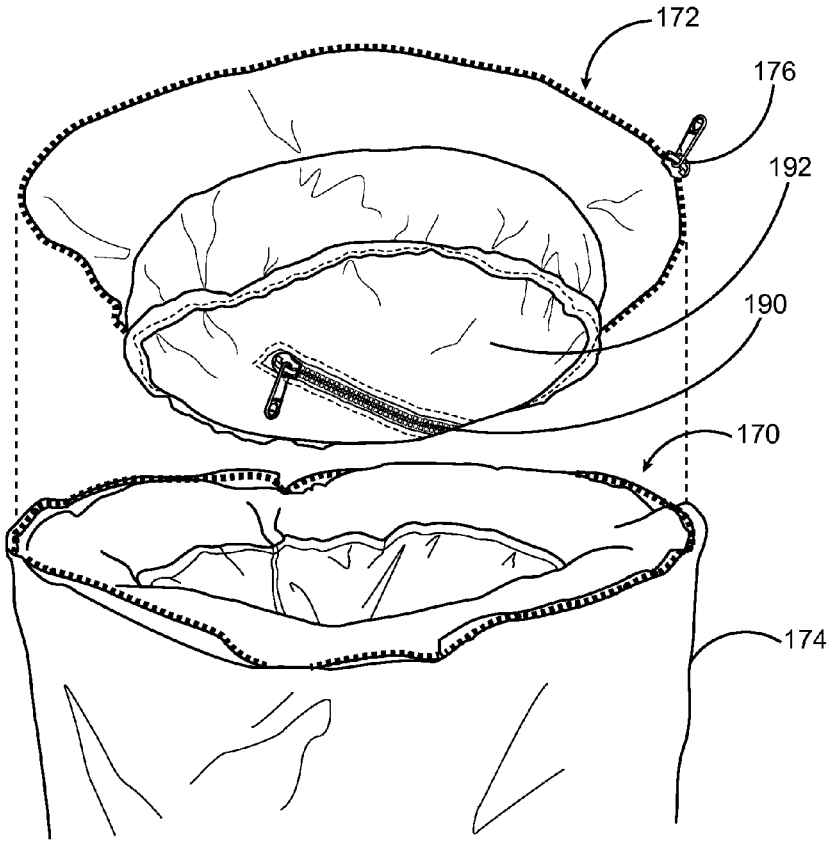
FIG. 7A illustrates a perspective view of another embodiment of the present invention.
Figure 7B:
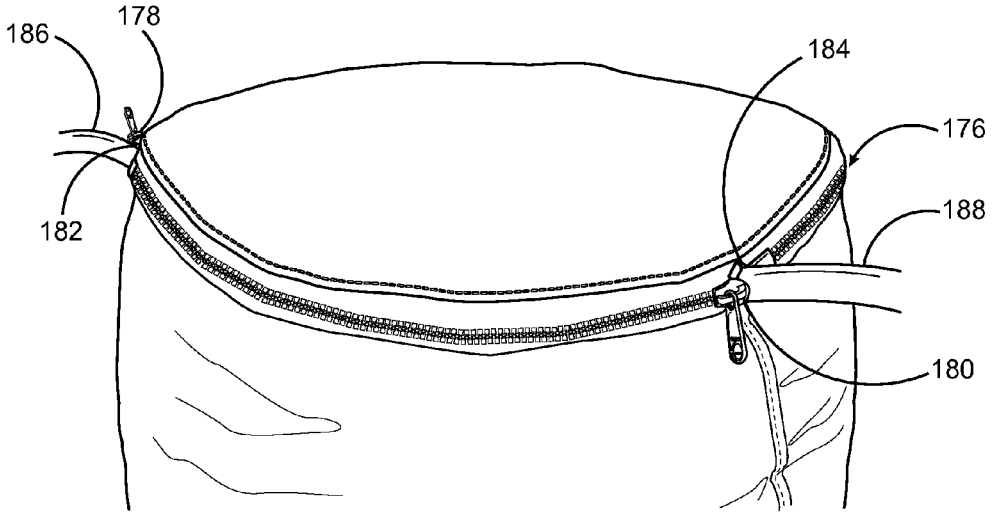
FIG. 7B illustrates a top perspective view of another embodiment shown in FIG. 7A.

FIG. 7A illustrates a perspective view of another embodiment of the present invention. The embodiments of the liquid vessel cooling system 100 illustrated in FIGS. 7A and 7B shows an insulation sleeve 170 having at least one covering means 172 that can be attached with a top portion 174 of the insulation sleeve 170 utilizing at least one fastening means 176. The at least one fastening means 176 is selected from a group consisting of: a hook and loop fastener, snap button, Velcro and zipper. Preferably, the at least one fastening means 176 is a zipper. The at least one covering means 172 is zipped at the top portion 174 of the insulation sleeve 170 utilizing the zipper 176 and is shaped as a plug. The at least one covering means 172 may additionally have a zipper opening 190 on an underside 192 thereof to gain access to a compartment which holds an insulating material. The compartment allows the user to replace the insulating material, remove the insulating material for more compact storage, or remove the insulating material for simple washing.

A refrigeration unit or other components can be attached temporarily or permanently with the insulation sleeve 170 or a support base utilizing at least one fastening means such as loop, Velcro, or other type of common mounting point. These components could be but are not limited to beer faucets, $CO_2$ tanks, other serving hardware, coasters, cup holders, marketing patches or signage.

FIG. 7B illustrates a top perspective view of another embodiment shown in FIG. 7A. The zipper 176 comprises two zippers 178, 180 that have gaps 182, 184 respectively between them large enough to allow a liquid line 186 and a carbon dioxide ($CO_2$) line 188 to pass between. By incorporating the gaps 182, 184 between the two zippers 178, 180, on site dispensing of the liquid contents of a container can be readily achieved without the necessity of exposing the container or its contents to the temperature of the ambient surroundings. The at least one covering means 172 when attached with the insulation sleeve 170 insulates but when removed allows for easier access to a top portion of the container when the user needs to attach/detach or service the serving hardware.

In yet another embodiment, the liquid vessel cooling system 100 can be incorporated with a handheld trigger valve $C_{O2}$ that is normally designed to fit with soda kegs or in bicycling to quickly pump up bike tires. Since valves in these systems are different from the Sankey keg coupler found in standard kegs and commercial breweries, the $C_{O2}$ hardware is retrofitted with the standard Sankey keg coupler. Furthermore in some embodiments retrofitting may include metering including but not limited to capillary tubing or a calibrated orifice or other flow resistance to restrict gas flow and provide more consistent and predictable serving speed and line pressure.

The presently disclosed system is advantageous because it is portable and lightweight. The liquid vessel cooling system 100 is clean, hygienic, and simple to use. Further, the liquid vessel cooling system 100 may be sized, contoured and constructed from materials dependent upon the needs and desires of the user, and further dependent upon the size, contour and nature of the container 116 being stored and transported within the liquid vessel cooling system 100. The insulation sleeve 124 is particularly constructed with a highly insulated wall construction throughout to protect the contents from ambient temperature conditions and is flexible to easily apply to any size and shape of the container 116 to hold the keg of liquid in its proper position in the cooling system 100 at all times.

The liquid vessel cooling system 100 has appropriate openings to accommodate the dispensing unit 154 to permit the dispensing of liquid from the container 116 while keeping the container 116 closed at all times. The container 116 is readily and conveniently held in proper position throughout the use of the liquid vessel cooling system 100 whereby the liquid of the container 116 is kept cold at all times. By virtue of the construction utilizing a flexible material and by the convenient location of the container 116, the liquid vessel cooling system 100 may be used with substantially any type of commercially available keg.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. An improved liquid vessel cooling system comprising:

a base assembly having a base housing with a top surface and a bottom surface, the top surface being attached to a thermally conductive support base;

a refrigeration unit enclosed within the base housing;

a container containing liquid having a top portion and a bottom portion, the bottom portion attached to the support base; and an insulation sleeve being removably positioned over the container through a first opening at a middle portion thereof;

wherein said support base is snugly encircled by a plurality of evaporator coils;

that are configured to induce convection currents within the container so as to enable more uniform cooling of the contained liquid; and wherein the cooling system comprises no air.

2. The improved liquid vessel cooling system of claim 1 wherein at least a portion of the plurality of evaporator coils is toroidal in shape.

3. The improved liquid vessel cooling system of claim 1 wherein the insulation sleeve includes a second opening at a bottom portion thereof to fill with an insulating material.

4. The improved liquid vessel cooling system of claim 1 wherein the container includes a spear that extends inside the container from the top portion to proximate the bottom portion thereof.

5. The improved liquid vessel cooling system of claim 4 wherein the spear allows a user to extract the liquid from the container while the container is in an upright position.

6. The improved liquid vessel cooling system of claim 4 wherein the spear is connected with a dispensing unit having a dispensing tap that is attached to a liquid line and a carbon dioxide (CO2) line.

7. The improved liquid vessel cooling system of claim 1 wherein the base assembly further comprises at least one wheel that is adaptable to provide movement of the improved liquid vessel cooling system while transporting.

8. The improved liquid vessel cooling system of claim 1 further comprising a carbon dioxide (CO2) system to facilitate charging the container and pushing the liquid out of the container.

9. The improved liquid vessel cooling system of claim 1 wherein the bottom portion of the container comprises an inner and outer rim and the system further comprising a locking mechanism that is configured to engage one of said rims to temporarily lock the container to the support base while transporting.

10. An improved liquid vessel cooling system for cooling, transporting and dispensing liquid comprising:

a base assembly having a base housing with a top surface and a bottom surface, the top surface being attached to a thermally conductive support base incorporating a plurality of evaporator coils;

a refrigeration unit enclosed within the base housing;

a container containing the liquid having a top portion, a bottom portion and a spear that extends inside the container from the top portion to proximate the bottom portion, the bottom portion attached to the support base; and an insulation sleeve being removably positioned over the container through a first opening at a middle portion thereof;

whereby the base assembly and the insulating sleeve are configured to effectively and efficiently cool the liquid contained within the container; and wherein the cooling system comprises no air.

11. The improved liquid vessel cooling system of claim 10 wherein at least a portion of the plurality of evaporator coils is toroidal in shape.

12. The improved liquid vessel cooling system of claim 10 wherein the plurality of evaporator coils are configured to induce convection currents within the container so as to enable more uniform cooling of the contained liquid.

13. The improved liquid vessel cooling system of claim 10 wherein the plurality of evaporator coils is further configured to control thermal conductivity of the container and allow walls of the container to be effectively cooled to form a thermal differential between the spear and the container.

14. The improved liquid vessel cooling system of claim 10 wherein the spear is connected with a dispensing unit having a dispensing tap that is attached to a liquid line and a carbon dioxide (CO2) line.

15. The improved liquid vessel cooling system of claim 10 wherein the insulation sleeve includes a second opening at a bottom portion thereof to fill with an insulating material.

16. An improved liquid vessel cooling system for cooling, transporting and dispensing a beverage, the liquid vessel cooling system comprising:

a base assembly having a base housing with a top surface and a bottom surface, the top surface being attached to a thermally conductive support base that comprises a plurality of cavities and passages making up a plurality of evaporator coils;

a refrigeration unit enclosed within the base housing;

a container containing the beverage having a top portion, a bottom portion and a spear that extends inside the container from the top portion to proximate the bottom portion, the bottom portion attached to the support base; and an insulation sleeve being removably positioned over the container through a first opening at a middle portion thereof, the insulation sleeve having a second opening at a bottom portion to fill with an insulating material;

whereby the base assembly and the insulating sleeve are configured to effectively and efficiently cool the beverage stored within the container; and wherein the cooling system comprises no air.

17. The improved liquid vessel cooling system of claim 16 wherein the plurality of evaporator coils is toroidal in shape.

18. The improved liquid vessel cooling system of claim 16 wherein the plurality of evaporator coils are configured to induce convection currents within the container so as to enable more uniform cooling of the contained beverage.

19. The improved liquid vessel cooling system of claim 16 wherein the spear allows a user to extract the beverage from the container while the container is in an upright position.

20. The improved liquid vessel cooling system of claim 16 wherein the spear is connected to a dispensing unit having a dispensing tap that is attached to a beverage line and a carbon dioxide (CO2) line.

* * * * *